175-40 SR
6/21/77 XR 4,030,558

United States Patent [19]
Morris

[11] 4,030,558
[45] June 21, 1977

[54] WEAR DETERMINATION OF DRILLING BITS

[76] Inventor: H. Rodney Morris, 1932 - 26th Ave. SW., Calgary, Alberta, Canada

[22] Filed: Sept. 15, 1975

[21] Appl. No.: 613,323

[52] U.S. Cl. ..... 175/39; 73/151; 175/40; 175/206

[51] Int. Cl.[2] ..... E21B 13/00

[58] Field of Search ..... 175/39, 48, 50, 40, 175/206, 308–312; 73/151.5, 153; 209/223 R, 223 A, 232,215; 210/222

[56] References Cited

UNITED STATES PATENTS

| | | | |
|---|---|---|---|
| 2,792,115 | 5/1957 | Medearis | 209/223 R |
| 2,965,406 | 12/1960 | LeBus, Sr. | 175/308 X |
| 2,966,059 | 12/1960 | Dower | 175/45 X |
| 3,089,724 | 5/1963 | Crooks | 175/308 X |
| 3,498,455 | 3/1970 | Kirby | 209/232 X |

OTHER PUBLICATIONS

A Method for the Study of Wear Particles in Lubricating Oil, Seifert et al., Wear 21 (1972).

*Primary Examiner*—Ernest R. Purser
*Assistant Examiner*—Richard E. Favreau
*Attorney, Agent, or Firm*—Shlesinger, Arkwright, Garvey & Dinsmore

[57] ABSTRACT

A method for determining the amount and character of rotary drilling bit wear without interruption of the drilling operation.

The method comprises flowing a drilling fluid through the borehole and around the bit with sufficient velocity to remove the formation and bit cuttings as well as dust and other fragments knocked or worn loose from the bit, placing a magnetic in close proximity to the recovered material such that a portion of the ferrous cuttings, fragments and dust are attracted to the surface of the magnet, removing the ferrous cuttings, fragments and dust from the magnet and examining them under an optical microscope to enable observation of their size, shape and color, and comparing the quantity, size, shape and color of the recovered ferrous material with the quantity, size, shape and color of ferrous cuttings, fragments and dust indicative of known conditions of bit wear.

25 Claims, 3 Drawing Figures

WEAR DETERMINATION OF DRILLING BITS

BACKGROUND OF THE INVENTION

This invention relates to a method for determining the amount and character of rotary drilling bit wear in situ and without interruption of the drilling operation. Although not limited to a specific type of drilling bit, this method has proved quite useful in evaluating the wear of rotary cone-type drilling bits.

One of the most common drilling bits for use in penetrating earth formations such as oil and natural gas wells is the roller-cone rock bit which comprises a plurality of toothed cutting cones which are rotatably mounted to a corresponding number of depending support arms commonly called "shirt tails". As the entire assembly is rotated, the cutting cones or wheels roll on the bottom of the borehole thereby chipping away the rock formations. As the bit advances downward, the loosened rocks and dust is carried away by the drilling fluid.

Bit wear in rotary drilling operations is a considerable problem for a number of reasons, perhaps the primary one being the fact that due to the large daily operation expenses, an optimum drilling rate is of the utmost importance. Since a worn bit will result in a slower drilling rate, a point is reached where it is economically desirable to pull the string and change the bit. Since this operation is quite time consuming and causes interruption of the drilling, the decision to change the bit must be made prior to pulling the drill string and repeated inspections of the drill bit are not possible. Also, a worn bit might be mistaken for an abnormally hard formation when in fact the rate might be increased by simply changing the weight and rotary speed of the bit.

An excessively worn bit may also result in the loss of a cone, thereby necessitating an expensive and time consuming fishing operation for its recovery. Also, a worn bit will generally cause the borehole to be undergauge which requires extreme caution in lowering the new bit to the bottom of the borehole because the under-gauge condition will cause pinching and rapid deterioration of the new bit unless the hole is first properly reamed.

since it is highly impractical to pull the drill string in order to periodically check the bit, a number of methods in the past have been proposed for determining the degree of bit wear in situ. One of the prior art methods entails the release of a dye or other detectable substance from the bit when a certain degree of wear has been achieved. This substance is released into the drilling fluid and carried to the surface where it is detected either by physical inspection or by an automatic detector. Other prior art solutions to the problem are the measurement of the loading, torque, or speed of the rotating bit and cones and then correlating this information to expected values of known conditions of bit wear. A difficulty with these last mentioned methods is that the bit wear is detected by measuring the performance of the bit itself or in some cases the entire string. This lends itself to misinterpretation because the performance of the drilling rig will often be affected by other factors not related to bit wear. Another difficulty with many of the prior art methods is that they indicate only the degree of wear and not the nature of the wear nor the most likely cause. This last aspect is quite important when abnormal bit wear occurs because it provides the opportunity to correct the situation prior to extensive damage to the bit.

OBJECTS OF THE INVENTION

It is, therefore, an object of this invention to provide a method for determining the wear of a rotary drilling bit whereby periodic monitoring can be accomplished without the interruption of the drilling operation.

It is a further object of this invention to provide a method for determining the wear of a rotary drilling bit wherein particles worn from the bit are directly examined.

A further object of this invention is to provide a method for determining the wear of the rotary drilling bit which does not require elaborate electrical equipment nor specially designed bits containing dyes, radioactive material, or other detectable substances.

Yet another object of this invention is to provide a method for determining the wear of a rotary drilling bit which indicates the nature and cause of the bit wear as it is occurring.

A still further object of this invention is to provide a method for determining the wear of a rotary drilling bit which may be used in conjunction with a standard drilling rig without the necessity for interferring in or changing its normal operation.

Yet another object of this invention is to provide a method for determining the wear of rotary drilling bits which yields an accurate indication at even the earliest stages of bit wear.

These and other objects and advantages of this invention will become apparent from a reading of the detailed description in light of the appropriate drawings.

SUMMARY OF THE INVENTION

A method for determining the wear of a rotary drilling bit comprises the steps of: circulating a drilling fluid through the borehole and around the bit with sufficient velocity to remove substantially all of the formation and bit cuttings as well as dust and other fragments knocked or worn loose from the bit, placing a magnet in close proximity to the removed cuttings, fragments and dust to attract a portion of the ferrous cuttings, fragments and dust to the surface of the magent, removing the attracted ferrous cuttings, fragments and dust from the magnet and examining the same under an image magnification device capable of enabling the observation of size, shape, and color, evaluating the ferrous cuttings, fragments and dust from the standpoint of bit wear by comparing their quantity, shape, size and color to the quantity, shape, size and color of ferrous cuttings, fragments and dust indicative of known conditions of bit wear. Permanent magnets or electromagnets can be utilized in the method of the invention.

BRIEF DISCUSSION OF THE DRAWINGS

DETAILED DESCRIPTION OF THE INVENTION

Figure 1:
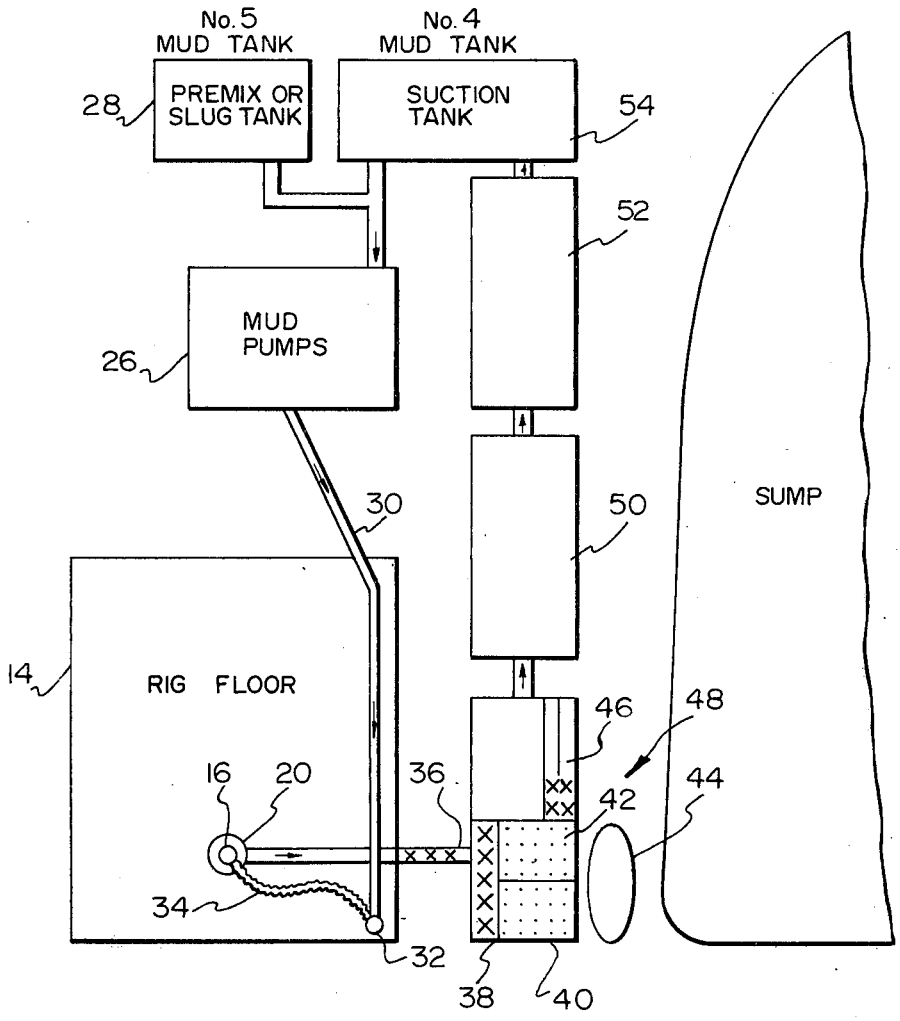
FIG. 1 is a schematic top plan view of a typical oil well drilling installation suitable for the practice of the present invention.
Figure 2:
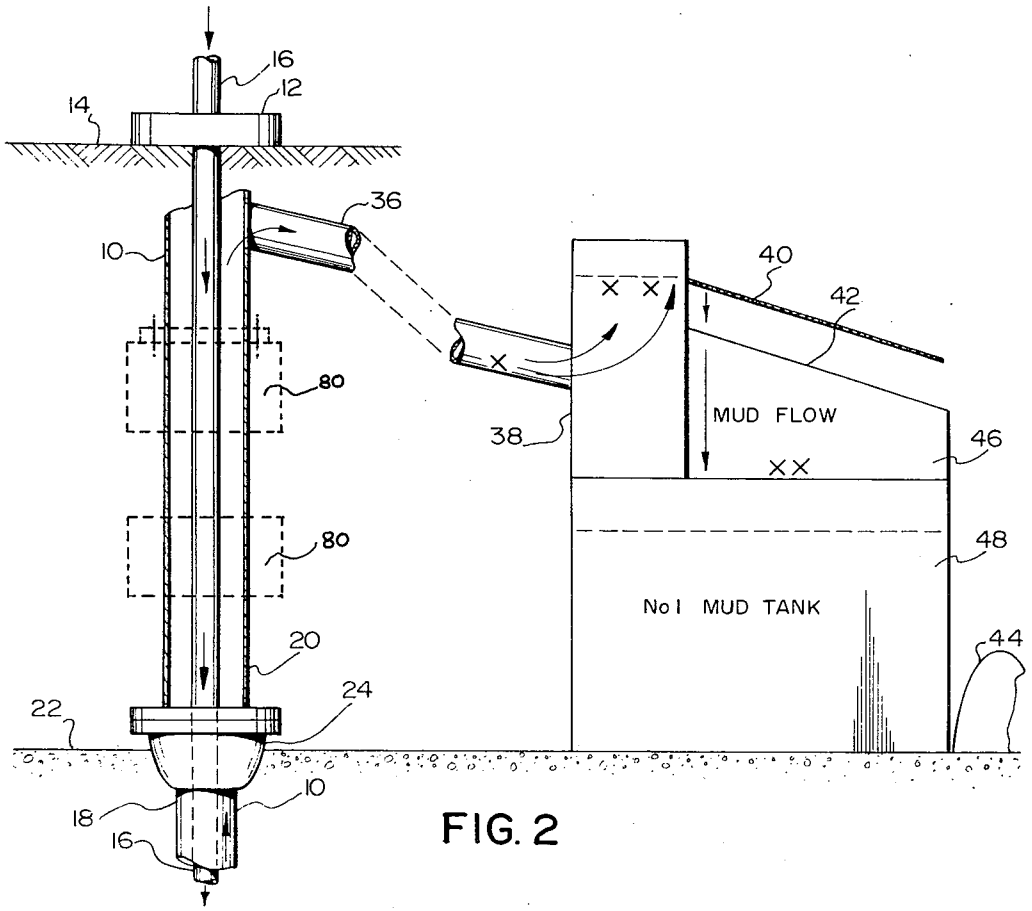
FIG. 2 is a schematic side elevational view of the oil well drilling installation utilizing air or gas as the circulating medium and suitable for the practice of the present invention.

Referring now to FIGS. 1 and 2, there is illustrated a typical oil drilling installation utilizing a drilling mud as the circulating fluid. In a manner well known in the art, the earth is penetrated by means of a drilling bit which, for purposes of the present discussion is of the rotary type wherein a plurality of toothed cones or wheels are rotatably mounted to a corresponding number of depending supporting arms hereinafter referred to as shirt tials. It should be noted, however, that the method of the present invention is not restricted to this particular type of bit but may be practiced in conjunction with a number of other types of drill bits depending on the experience of the operator with the type of particles and cuttings produced by various types and degrees of bit wear. The bit (not shown) is connected to a drill string which comprises a plurality of tubular drill pipe 10 rotated by a table 12 rotatably mounted on the rig floor 14. By virtue of the weight applied to the drill pipes 10, the bit is caused to penetrate the earth as it is rotated. During the rotary drilling, drilling mud is circulated down a square or hexagonal (in cross-section) drilling pipe commonly called a "kelly" 16 which extends for 40 feet and is connected below to drill pipe which extends the entire length of the borehold ad permits the drilling mud to be circulated around the bit whereupon it is forced through the annular area surrounding the kelly. Near the surface of the borehole, this annular area is sealed by means of a surface casing 18 which connected to the blow-out preventors 80 (shown in phantom) and then a conductor pipe 20. Normally, this connection between the surface casing 17 and the conductor pipe 20 is made at ground level 22 through a casing bowl 24.

The mud is forced down the kelly 16 by means of a mud pump or pumps 26 which draws fresh mud from suction mud tank 54 and forces it through shock hose 30, standpipe 32 and kelly hose 34. The returning mud which carries with it the formation and bit cuttings as well as ferrous dust and other fragments is forced upwardly through surface casing 18, casing blow 24 and conductor pipe 20 and 10 whereupon it is diverted into flow line 36. From flow line 36 it flows into surge tank 38 and passes over a plurality of shale shaker screens 40 and 42. This separates much of the formation and bit cuttings and ferrous dust and fragments and deposits this material in a pile 44. The mud which passes through the shale shakers 40 and 42 flows into one or more ditches 46 and then into a series of mud settling tanks 48, 50, 52, and 54 wherein the finer particles settle to the bottom and provide a supply of fresh mud to pumps 26.

Figure 3:
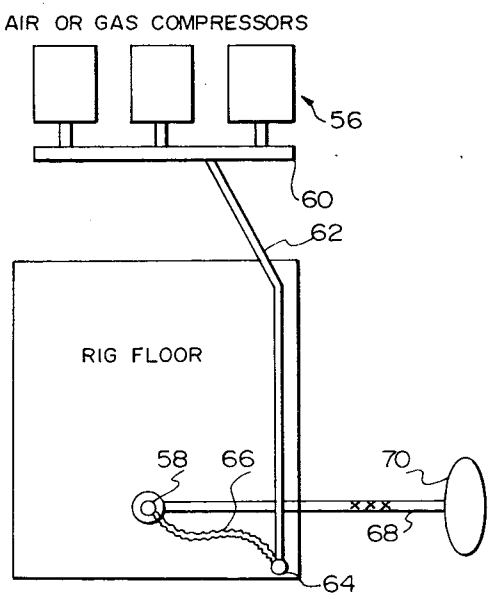
FIG. 3 is a schematic top plan view of a typical oil well drilling installation utilizing air or gas as the circulating medium and suitable for practice of the present invention.

In FIG. 3, there is illustrated a typical oil drilling rig which uses natural gas or air as the circulating medium in place of the drilling mud discussed in connection with FIGS. 1 and 2. Air or gas compressors 56 supply pressurized air or gas to kelly 58 through manifold 50, hose 62, standpipe 64 and kelly hose 66. This air is circulated through the borehole, around the bit and up through the annular space between the kelly and borehole carrying with it the formation and bit cuttings as well as ferrous dust and fragments worn or knocked loose from the bit. These particles are then forced through return line 68 and deposited in a pile 70.

In order to determine the amount of drill bit wear which has occurred, it is necessary to separate the ferrous cuttings, dust and other fragments which have been worn or knocked loose from the drill bit. In general terms, this is accomplished by placing a magnet in close proximity to the recovered formation and bit cuttings and particles to thereby attact a portion of them and permit their removal. This may be done by either holding a horse shoe type hand magnet over the pile of formation and bit cuttings 42 or 70 or by immersing a magnet within the following fluid. The procedure for separating and cleaning the ferrous particles, fragments and cuttings will be discussed in detail at a later point after a discussion of considerations relating to the drilling fluid and the origin of the ferrous dust and cuttings.

During rotary drilling, mud is circulated down the kelly and up the annulus for a number of reasons, two of the primary ones being firstly, to cool and clean the bit and secondly, to remove the formation cuttings from the borehole. The ability of the drilling fluid to remove the cuttings from the hole is affected by such factors as mud plastic viscosity, mud gel strength, mud yield point, mud density, mud annular velocity and variations in hole diameter. Of these factors, the annular velocity of the mud is considered the most important within a rather wide range of mud viscosities and is preferably between 100 to 130 feet per minute. In order to recover the bit cuttings, fragments and dust, it is necessary to insure that the carrying capacity of the mud is adequate to effectively remove the formation cuttings from the hole. Unless the mud carrying capacity is sufficient to accomplish this, the accuracy and reliability of the present method for determining bit wear conditions will fall off markedly. This is because of the necessity that substantially all of the bit cuttings, fragments and dust be brought to the surface to permit representative sampling to be made.

Although a annular mud velocity of 100 to 130 feet per minute has been indicated as sufficient to remove substantially of the formation cuttings, it should be noted that this conclusion is correct only if the hole is in gauge and it does not have cave conditions. Should the hole be over-gauge or have cave conditions, the calculated annular velocity is not obtained and the hole is not being adequately cleaned so that a portion of the bit cuttings, fragments and dust is not reaching the surface. Although borehole caliper logging is the most reliable method for determining the dimensions of the hole, indications that it is not being cleaned include the following: the presence of round shale particles that have remained in the hole for a long time before reaching the surface, the predominance of very fine formation cuttings because the mud lacks the carrying capacity to lift the larger cuttings, and the absence or near absence of cuttings that will not pass through the shaker screen. If these conditions are noted, corrective action must be taken to assure the proper annular mud velocity prior to taking samples of the ferrous dust and cuttings.

At this point, it should be noted that for purposes of this application, the term "ferrous" is used in a somewhat broader than normal sense and is understood to mean all iron and iron containing metals as well as metals which will be attracted by a magnet.

When the ferrous portion is separated from the formation cuttings, it will consist of the following material in order of abundance:

1. Pipe scale: In most wells, the principal contaminant of the ferrous dust and ferrous cuttings will be pipe scale which has the appearance of broken fragments of brown rust beads. These have formed on both the inside and outside of the drill string while it was racked. Although the pipe scale will form about 50% of the magnetic sample, its presence should be ignored when recording the data of the ferrous cuttings. Pipe scale will be recovered throughout the entire drilling operation because rusty joints of drill pipe are continually being added to the drill string from the rack.

2. Ferrous cuttings: The ferrous cuttings are defined as those pieces of steel which will not normally pass through a 40 mesh screen. They consist of fragments of steel generated by the wearing of the downhole equipment and will vary in size, shape and color throughout the life of the drilling bit and other downhole equipment.

3. Bit tooth and button fragments: Because the bit tooth and button fragments are often large and blocky in shape, they will not be recovered at the surface unless the carrying capacity of the drilling fluid is high. Generally, they will remain near the bottom of the hole until they have been reduced in size sufficiently to be carried to the surface. They have a tendency to collect in caves because of their size and density and because the slow moving mud environment has caused them to quickly settle out of the mud stream.

4. Ferrous dust: Ferrous dust will often not be found in the magnetic fractions separated from the formation cuttings which have been deposited by the shale shakers or lost through the 40 mesh sieve which is used to wash the larger particles as will be described in greater detail hereinafter. When the magnet or magnets are immersed directly within the drilling fluid, however, the recovered steel dust will form a very high percentage of the magnetic sample.

A larger than normal yield of ferrous dust and ferrous cuttings will be recovered by the immersed magnet following a trip (raising the drill string out of the borehole and then subsequently lowering it into position) for three reasons. Firstly, the worn bit will have been producing its maximum amount of ferrous cuttings and dust immediately prior to the trip; secondly, the round trip of the drill string will have generated both ferrous dust and ferrous cuttings from the string's contact with the casing and the walls of the hole, thirdly, the trip will probably have disturbed the cave sections thereby causing a partial unloading of their accumulated cuttings.

The ferrous dust, cuttings and fragments which are recovered from the borehole will have the following origins:

1. Drill pipe and drill collars — As the drill pipe rotates, considerable wear occurs. The wear on the outside of the drill string originates from both the rubbing of the drill pipe on the casing (either surface or intermediate) as well as from the rubbing of the drill string on the walls of the hole. Most of the normal wear of the drill pipe and drill collars will produce pipe scale and ferrous dust. The amount of ferrous dust generated is large and its color almost without exception is silver, indicating that it was formed without the generation of a high degree of heat.

2. Stabilizers — Rotating metal stabilizers will contribute ferrous dust and ferrous cuttings from their contact with the abrasive wall of the hole. As most varieties of this type of stabilizer are protected from wear by tungsten carbide inserts, mostly ferrous dust will be produced with an occasional ferrous cutting. Non-rotating stabilizers may have a steel-to-steel contact between the non-rotating part of the stabilizer and the body of the stabilizer and will definately have a steel-to-steel contact when the plastic sleeve is worn. Not only is considerable ferrous dust created along this rotating-contact surface throughout the life of the stabilizer, but also ferrous cuttings are formed as the wear allows the ends of the non-rotating portion to bear heavily on the body portion.

3. Near-bit reamers — The near-bit reamer not only serves as a stabilizer, but insures that the hole is kept to gauge even if the bit is out-of-gauge. Consequently, it is subject to considerably wear both from the cutting action of the tapered reamer cones and from the wear of the cones on the supporting pins. Seldom are the tungsten carbide buttons on the cutting surface of the tapered cones found to be broken but are rather abraded to a flattened condition thereby producing a certain quantity of ferrous dust. The "chert-type" tapered cones will also be abraded to a dust with a rare broken fragment of hardfaced steel. The wear of the cones on the pins will also produce ferrous dust. If the near-bit reamer is reaming a severe under-gauge hole left by the previous bit, the force exerted at the upper surface of the tapered cones on the reamer body will produce small blue spheres of steel whose once molten condition is indicative of the heat at their source.

4. Rotary drilling bit — The rotary drilling bit is normally subject to more wear than any other part of the drilling string. By the rolling action of the cones, the teeth are made to dig into the formation and chip out small flakes and fragments. In a toothed bit, the teeth are hardfaced to withstand the abrasiveness of the formation but once the hardfacing has been worn away, the softer core of the bit teeth become exposed and thereafter abrasion proceeds rapidly.

As may be expected, a considerably reduction in bit life is experienced if some of the teeth are broken. The teeth fragments are difficult to lift off the bottom and difficult to keep from settling back to bottom because of their size and density. Furthermore, when these fragments become caught between the meshing bit teeth, further tooth breakage occurs. The same situation happens with the breaking of tungsten carbide buttons or the plucking of buttons from the bit cones. Because of their size and density, they are difficult to carry to the surface unless the carrying capacity of the mud is excellent. They generally remain at or near the bit until broken into small enough fragments to be lifted from the hole.

The surfaces of the bit cones between the teeth show surprisingly little wear or abrasion providing the teeth or buttons are near full length and unbroken. Cone surface wear starts as soon as the worn or broken teeth or buttons or from the use of excessive weight on the bit allow the cone surface to come in contact with the bottom of the hole resulting in flatened pieces of steel having numerous scratch lines being removed from the cone surface. The outer faces of the shirt tail of the bit are protected from wear by the concentration of hardbanding or gauge buttons of the outer edges of the cones which insure a hole that is at gauge. As this gauge protection becomes worn, the shirt tail is exposed to the abrasive action of the under-gauge hole and will also be worn from the abrasive action of formation cuttings caught in the filter cake between the shirt tail and the wall of the hole. Other wear occurs while drilling steeply dipping formations due to the tendency of the bit to lean to one side of the hole. Normal early wear of the shirt tail of the bits results in the formation of ferrous dust and as the wear becomes more severe from an under-gauge hole, both ferrous dust and ferrous cuttings will be formed.

The cone bearings form an important part of the bit and a reasonably long bit life can be anticipated if the bearings do not fail. Once the grease seals have broken and drilling fluid with abrasive silt enters the bearings, however, it becomes only a relatively short time before the bearings become worn to the extent that the outer faces of the cones rub on the shirt tails of the bit. The wear of the ball and roller bearings may be expected to produce ferrous dust and cuttings with an increase in the percentage of cutting in proportion to bearing wear. These ferrous cuttings will be discolored from a silver to a bronze or blue depending on the amount of friction.

As the bearings become progressively worn, the cones move from their original position to a slightly off-center position, allowing a meeting of the outer cone surface with the shirt tail of the bit. As the bearing wear continues, the contact of the cone and shirt tail first produces ferrous dust, followed by ferrous cuttings which will not only change in color from silver to bronze, to blue, but will change in shape from elongated shapes to open spirals to tight spirals as the bearing wear progresses.

Returning now to the drawings, the methods for collecting the ferrous cuttings will be discussed. There are two methods for collecting ferrous cuttings at the surface of the well, one of which is more effective during the early stages of drilling and the other more effective as the borehole becomes deeper.

The first method should be used in the upper portion of the well when large diameter bits are being used, i.e. bits having a diameter of/or greater than 12¼ inches. Although the first method recovers only a small portion of the ferrous cuttings originating from the drilling bit, this is adequate to furnish the necessary data because of the large amount of steel coming from the large diameter bit.

In the first method, a representative formation cuttings sample is taken preferably from an automated sample catching device (not shown) at the shale shakers 40 and 42 or alternatively from the pile of formation cuttings 44 discharged from shakers 40 and 42 or from cuttings 70 (FIG. 3). It is preferable to take a one-quart sample for every ten foot drilling interval although if the penetration rate is slow (more than 15 minutes per foot), a sample should be taken for each hour of drilling. If there are twin shale shakers, such as illustrated in FIGS. 1 and 2, the samples should be taken from the shaker with the finest sieve. If there is only a single shale shaker and it is equipped with a coarse screen, it will be necessary to replace it with a fine sieve, not coarser than 40 mesh in order not to loose the ferrous cuttings through the screen. For all samplings, it is necessary to take a uniform amount of the formation cuttings in order that representative results be obtained.

The formation cuttings sample is washed by placing it in a coarse screen sieve (preferably 5 mesh) and then placing this screen above a fine screen (40 mesh). The two screens are then placed in water and the samples washed to separate the cavings, which remain in the coarse sieve, from the formation cuttings which will be caught in the lower sieve. The material in the coarse sieve is discarded and the material in the fine sieve is further washed until it is thoroughly clean and free from all adhering drilling fluid and fine dusty cuttings. The addition of salt or SAPP (sodium acid pyrophosphate) to which a small amount of surfactant has been added to the water will accelerate the washing of the sample. If the drilling fluid is oil based, it will first be necessary to wash the cuttings in chlorothene. The sample is then rinsed in clean clear water and the excess water is shaken from the sample to reduce the drying time. Another method for removing the excess water from the sample is to place the sieve containing the clean formation sample on a slightly damp sponge.

Following te washing operation, the sample is dried in a heavy metal container by placing it over low or moderate heat. It is important to use a lower or moderate heat to avoid raising the temperature of the ferrous cuttings to a point where the normally silver cuttings will be changed to a bronze or blue color. Furthermore, the samples should not be shaken during drying until near the end of the drying operation because the shaking of wet or damp formation cuttings will rub the cuttings against each other forming a mud to which the ferrous cuttings will adhere.

When the sample is dry, it is then spread out uniformally on a flat surface and a horse shoe type hand magnet of approximately 2 inch × 2 inch dimensions which has been enclosed in a 1 mil thick plastic bag is passed over the sample in such a manner that it passes close to the cuttings but does not touch them. If the magnet is run through the formation cuttings, a considerable number of ferrous cuttings will be dragged from the magnet by contact with the formation cuttings. It should be noted that only steel or ferrous cuttings and fragments will be attracted to the magent, the ferrous dust having been removed by the washing operation described above.

The ferrous cuttings are removed from the magnet by placing the enclosed magnet in a non-ferrous tray and carefully removing the magnet from the plastic bag, thereby allowing the ferrous cuttings to fall from the outside of the bag to the tray.

The ferrous cuttings are then examined under a binocular microscope having a 10× capability and a record is noted of the following data:

1. The total number of ferrous cuttings.
2. The total number of silver colored cuttings, the total number of bronze colored cuttings and the total number of blue colored cuttings.
3. The total number of each particular shape of cuttings for each color. With regard to this characteristic, the following shapes are important to note: flat, plain, chattered, open spiral, tight spiral and molten balls.

Having observed the ferrous cuttings from the standpoint of amount, color and shape, the degree and type of bit wear may be determined by comparing this data with similar data indicative of known conditions of bit wear in a manner which will be described in detail at a later point.

The second method for recovering the material worn from the bit is used in the lower portion of the well when bits less than 12¼ inch in diameter are being used. This method recovers most of the ferrous cuttings originating from the drilling bit and thus is essential to predict the near critical condition of small bits (8½ inches to 6 inches) in which bearing failures will occur after the loss of a relatively smaller amount of steel. It should also be noted that this method results in the recovery of the ferrous dust in addition to the ferrous bit cuttings and fragments.

Rather than taking the sample from the pile of formation cuttings discharged by the shale shakers 40 and 42 or the return line 68, one or more magnets are immersed within the stream of drilling fluid. Referring to the installation illustrated in FIGS. 1 and 2, the optimum location for the magnet is in the mud surge tank 38 at the rear of the shale shakers 40 and 42 directly above the point of entry of the flow line 36. The preferred position for suspending the magnet or magnets is indicated by the symbol "X" in surge tank 38. An alternative position for the magnet or magnets, in the event that the mud by-passes the shale shakers, is within flow line 36 or in the ditch and mud tanks 48 or 50. Again, the positioning of the magnet or magnets is indicated by the symbol X. With the drilling rig illustrated in FIG. 3, the preferred location for the magnet or magnets is within return line or "blooey" line 68 at the locations indicated by the symbol X.

The type of magnet recommended for this method is a tube-type magnet approximately 1 inch in diameter by 12 inches to 48 inches in length, composed of magnetic ceramic discs enclosed within an aluminium tube which is closed at both ends by inserting aluminium discs in the ends of the tube and then closing the tube over the end discs. Care should be taken to prevent the entry of any drilling fluid into the interior of the tube by sealing the ends with an epoxy resin. It is also desirable to coat the outside of the tube with epoxy resin to prevent pitting of the aluminium by corrosive chemical action from some of the drilling fluid additives and to facilitate the removal of the ferrous dust and ferrous cuttings.

If desired four of the tube-type magnets approximately 48 inches in length be used to recover the maximum amount of steel being generated at the bit.

If a button bit larger than 12 ¼ inches in diameter is being used, it is recommended that a single tube-type magnet 12 inches in diameter be suspended within the mud stream for 20 minutes every four hours early in the life of the bit and 20 minutes every hour late in the life of the bit. When 8½ inches or 6 inches diameter bits are used, it is recommended that four tube-type magnets 48 inches in length be suspended in an aluminium rack in the mud surge tank at the rear of the shaker in order to collect nearly all the ferrous dust and ferrous cuttings originating at the bit. This will necessitate leaving the magnets continually in contact with the mud and stripping their collected steel at regular intervals. It is important that the sampling or immersion time of the magnets be uniform at all times in order that the quantity of various colors and shapes of ferrous cuttings may be correlated to the amount of steel being lost at the bit in that time. Relative to the smaller diameter bits, the sampling frequency should be increased near the end of the expected bit life.

Wearing rubber gloves or other hand protection, the ferrous dust and cuttings from the tube-type magnets is stripped by encircling the magnet with the fingers and sliding the cuttings to the end of the tube where they fall into a receptacle. If the drilling fluid is waterbase, the ferrous dust and cuttings are washed with water to which has been added a small portion of a concentrated SAPP solution to which a small portion of surfactant has been added to aid in the breakdown and removal of drilling mud. If the drilling fluid is oil base, or oil invert, the ferrous dust and cuttings are washed in a chlorothene bath to remove the oil, following by water and SAPP wash. Care must be taken while washing the ferrous dust cuttings to decant none of the very fine ferrous dust which has a tendency to remain in suspension. The ferrous dust and cuttings are then rinsed with clear clean water and dried in a heavy metal container as previously described.

When the ferrous cuttings and dust are dry and have been cooled, the dust and cuttings are weighed and record is made of their weight. Using a dry 40 mesh sieve, the ferrous dust is weighed and examined under a 30× binocular microscope to ascertain what percentage, if any, is discolored from a silver color to a bronze or blue. The ferrous cuttings are then examined under a 10× binocular microscope and a record is made of the same data as discussed in connection with the first method.

In order to use the data acquired from the microscopic examination and weighing of the ferrous dust, cuttings and fragments, it is necessary to correlate this data with data obtained earlier in the life of the bit as well as with data obtained in conjunction with the wear of other bits. Although the manner in which the drilling string is operated, the type of circulating fluid, design of bit must be considered when interpreting the significance of the amount, shape and color of the ferrous dust, cuttings and fragments, certain characteristics may be attributed to the degree and type of bit wear which is occurring. This will be discussed more fully hereafter.

Relative to the amount of ferrous dust and cuttings recovered at the surface will depend greatly on the size of bit which is presently in use. A 12¼ inch bit is both large and rugged so that a large quantity of steel must be removed from the outer cone bases and the shirt tail of the bit before the bearings are worn and exposed to the degree that one or more cones may be left in the hole. The amount of ferrous material to be removed from an 8½ inch bit or a 6 inch bit is proportionally less to reach the same degree of wear. Therefore, it is important to expect a large decrease in the amount of ferrous dust and cuttings when the hole is reduced in size. It is essential that whether the ferrous dust and cuttings are collected at the surface from the formation cuttings or from the tube-type magnet, that the magnetic samplings be frequent and at uniform periods throughout the life of the bit in order to provide an accurate history of the downhole steel losses throughout the normal life of the bit, and to forewarn premature bit failure from such causes as pinched bits, broken seals and broken or plucked buttons.

During normal bit life, the first indications of bit wear will be the recovery of silver colored, irregularly shaped, elongated steel cuttings which will appear in the first 15% of bit life and will continue thereafter with some of these ferrous cuttings showing a change in color to bronze commencing after 40% of bit life and some cuttings showing a change of color to blue commencing after 70% of bit life. Not only will there be a color change in the irregular elongated cuttings throughout the life of the bit, but there will also be a change in the shape of some of the ferrous cuttings. For example, after 40% of bit life, slightly twisted slivers of ferrous cuttings will appear and will change in color from silver to bronze to blue during the remainder of the bit life. After 70% of bit life, coarse, tightly twisted spirals (resembling metal lathe turnings) will appear first in a silver color followed by a rapid change to bronze and blue. When blue colored tightly twisted spirals appear in three or more pieces per sample, it may be predicted that the remaining bit life, before cones will be lost, is as follows:

12¼ inches bit — 10 to 14 hours
8½ inches bit — 4 to 6 hours
6 inches bit — 1 to 3 hours Of course, these times must be adjusted for such factors as change of bit weight or rotary speed, torquing and bouncing during the remaining hours of bit life. At such time as the blue spirals appear in quantity, the bit should be considered as under-gauge. The coarse spirals are formed when the bearings become sufficiently worn to allow a semi-continuous contact of the base of the cone with the innerface of the shirt tail thereby producing a metal cutting action similar to that of the metal lathe.

In addition to the above characteristics of the ferrous cuttings, which indicate normal bit wear, abnormal conditions will be evidenced by the amount, shape and color of the cuttings. Abnormal conditions may be said to exist when the following situations are encountered:

1. Under-gauge hole
2. Loss of bit teeth or buttons
3. Excessive torquing and
4. Bit bouncing Should an under-gauge bit be pulled, only the hole between the bit and the near-bit reamer will be under-gauge, providing the near-bit reamer has reamined in gauge, and it is difficult to ream this short section of under-gauge hole with a new bit without pinching the cones. If the cones of the bit become pinched during the reaming, bronze and blue, open and tight spirals of steel will be produced from the pressing of the rear portion of the cone on the shirt tail. In addition, fragments of hardbanding from the base of the shirt tail will be found. Should the hole be only slightly under-gauge (1/16 inch), little bit damage should be expected during the careful reaming and the bit will reach bottom in a relatively good condition; furthermore, any production of spiral shape ferrous cuttings will cease when the bit starts to make a new hole. Should the hole be badly under-gauge (3/8 inch or greater), considerable bit damage will be expected if the hole is not carefully reamed with the bit. Poor reaming will allow the bit to reach the bottom in a badly pinched condition and drill a new under-gauge hole, which will shorten the bit life up to 90%. In such instances, silver, bronze, and blue tight steel spirals will appear during the reaming period and continue during the drilling period. Accordingly, if the previous bit was badly under-gauge, careful sampling should be started as soon as circulation is commenced and continue at short time intervals thereafter to check the condition of the bit during reaming and in the first hours after the drilling is commenced.

The breakage of bit teeth or buttons may be caused from drilling on iron or fragments of hard formation. Once a bit tooth or button breaks, it very often breaks further teeth which become caught in the meshing cones. A minor bit tooth breakage results in a slight slowdown in penetration rate but a sudden loss of a number of bit teeth results in a sudden drop in penetration rate which could mistakenly be interpreted as the encountering of a hard, tough formation. A quick check of the formation cuttings and the magnetic sample will clearly show the cause of the slowdown.

If the bearings of the bit seize and the cone starts to skid on the bottom of the hole, it will produce flat elongated shape ferrous cuttings that will become bronze and blue as the skid area of the cone increases.

The determination of the cause of bit torquing is aided by an examination of the ferrous cuttings. If the amount of ferrous cuttings is small, silver colored and without tight spiral shapes, the cause of the torquing can be explained by formational characteristics such as swelling anhydrite or broken formation, which can be confirmed in the formation samples. On the other hand, if the ferrous cuttings show all of the criteria of excessive tooth or bearing wear with a noticeable increase in ferrous cuttings volume, then the torquing will most likely be caused by either iron in the hole or a worn or under-gauge bit.

The bouncing of the bit during any stage in its life will produce ferrous cuttings that have all of the criteria of excessive bearing wear. The bouncing action results from the bit being raised in order for a cone to roll over a fragment of formation on the bottom of the borehole thereby putting most of the weight on that cone which is rolling over the fragment. This excessive weight on one cone causes the outer surface of the cone to momentarily rub on the shirt tail thereby producing steel fragments that are chattered in appearance and bronze or blue from the frictional heat. Further damage occurs when the cone rolls off the formation fragment and in effect the bit drops on bottom with not only the weight being carried on the bit but also an excess of weight from the compression of the drill string. The impact of the bit on bottom causes a springing of the bearings momentarily allowing the cones to again come into contact with the shirt tail resulting in the formation of large, colored ferrous cuttings with a chattered appearance plus an occasional tight spiral. Thus, if a bit is bouncing, some discretion must be used in assessing the bit and bearing wear from ferrous cuttings. It should be realized that if a bit is drilled with a bounding action, its life span will be reduced in proportion to the duration and severity of the bounding.

Should the surface casing be set in a crooked hole, excess wear will occur on the drill string and the casing resulting in large volumes of ferrous dust and ferrous cuttings. These cuttings will most likely be silver in color and or an irregular but elongated shape without the bronze and blue color or spiral shapes which are indicative of bit tooth or bearing wear.

Spiral shaped cuttings also render a very good indication of the degree of bearing wear with the needle-thin open spiral cuttings being indicative of preliminary cone wear on the shirt tail and the tight coarse spirals, which indicate extreme bearing wear, i.e. the cone rubbing severely on the shirt tail. Relative to the color, silver colored cuttings which are the color of natural steel generally indicates only slight wear with rubbing which occurs without significant heat generation. As the color of the cuttings changes from bronze and then to blue, this indicates that the bearing wear has progressed to the point where the rubbing action creates a significant amount of heat.

The ferrous dust is not the primary indicator of bit wear, it can be the result of casing-drill string wear, drill string wear on the formation, wear within the bit (i.e. cone against shirt tails), wear within a rotating and non-rotating stabilizers, near-bit reamers and also normal bearing wear. The color of the dust is indicative of the temperature at which it was formed ranging from silver to blue.

While this invention has been described as having a preferred design, it will be understood that it is capable of further modification. This application is, therefore, intended to cover any variations, uses or adaptations of the invention following the general principles thereof and including such departures from the present disclosure as come within known or customary practice in the art to which the invention pertains and as may be applied to the essential features hereinbefore set forth and fall within the scope of this invention or the limits of the appended claims.

What is claimed is:

1. In a rotary drilling operation, a method for determining the wear of the bit comprising the steps of:

circulating a drilling fluid through the borehole and around the bit with sufficient velocity to remove the formation cuttings and the cuttings, fragments and dust worn loose from the bit, placing a magent in sufficiently close proximity to the removed cuttings, fragments and dust to attract a portion of the ferrous cuttings, fragments and dust present therein to the magnet thereby separating the ferrous material for the removed formation cuttings, removing the attracted ferrous material from the magnet, examining the ferrous material under an image magnification device suitable for the observation of the shape and color of the cuttings and fragments forming a portion of the ferrous material so as to permit an evaluation of the observed shape and color of the ferrous cuttings and fragments with respect to the shape and color of ferrous cuttings and fragments indicative of known conditions of rotary bit wear.

2. The method of claim 1 and including the step of weighing the attracted ferrous material to determine the amount recovered.

3. The method of claim 1 and wherein the ferrous material is separated from the formation cuttings by passing a magnet in close proximity to a sample of formation cuttings and bit cuttings, fragments and dust which had previously been separated from the drilling fluid.

4. The method of claim 1 and wherein said image magnification device is an optical microscope.

5. The method of claim 1 and wherein the magnet is immersed in the drilling fluid stream.

6. The method of claim 1 and including the step of counting and recording the number of attracted ferrous cuttings and fragments of a particular color.

7. The method of claim 1 and including the step of counting and recording the number of ferrous cuttings and fragments having a particular shape.

8. In a rotary drilling operation, a method for determining the wear of the bit comprising the steps of:

circulating a drilling fluid through the borehole and around the bit with sufficient velocity to remove the formation cuttings and the cuttings, fragments and dust worn loose from the bit, placing a magnet in sufficiently close proximity to the removed cuttings, fragments and dust to attract a portion of the ferrous cuttings, fragments and dust present therein to the magnet thereby separating the ferrous material from the removed formation cuttings, removing the attracted ferrous material from the magnet, separating the ferrous dust from the attracted ferrous material, and subsuquently examining the ferrous material under an image magnification device suitable for the observation of the shape and color of the cuttings and fragments forming a portion of the ferrous material so as to permit an evaluation of the observed shape and color of the ferrous cuttings and fragments with respect to the shape and color of ferrous cuttings and fragments indicative of known conditions of rotary bit wear.

9. The method of claim 8 and wherein the ferrous dust is weighed separately to determine the amount recovered.

10. The method of claim 9 and wherein the ferrous cuttings and fragments are weighed separately from the ferrous dust to determine the amount of cuttings and fragments recovered.

11. The method of claim 8 and wherein the ferrous dust is separated by washing the attracted ferrous material in a sieve having openings large enough to pass the ferrous dust yet small enough to retain the ferrous cuttings and particles.

12. The method of claim 11 and including the additional step of drying the washed ferrous fragments and cuttings.

13. In a rotary drilling operation, a method for determining the wear of the bit comprising the steps of:

circulating a drilling fluid through the borehole and around the bit with sufficient velocity to remove the formation cuttings and the cuttings, fragments and dust worn loose from the bit, removing from the drilling fluid formation cuttings and the cuttings, fragments and dust worn loose from the bit, washing the formation cuttings and bit cuttings, fragments and dust separated from the drilling fluid on progressively finer sieves to separate out the material which will pass through all of the sieves except the finest sieve thereby eliminating dust and the large formation fragments, placing a magnet in sufficiently close proximity to the material collected within the finest sieve to attract a portion of the ferrous material present therein, removing the attracted ferrous material from the magnet, and examining the ferrous material under an image magnification device suitable for the observation of the shape and color of the cuttings and fragments forming a portion of the ferrous material so as to permit an evaluation of the observed shape and color of the ferrous cuttings and fragements with respect to the shape and color of the ferrous cuttings and fragments indicative of known conditions of rotary bit wear.

14. The method of claim 13 and wherein two sieves are employed in the washing operation, one being approximately 5 mesh and the other being approximately 40 mesh.

15. In a rotary drilling operation, a method for determining the wear of a rotary drilling bit comprising the steps of:

circulating a drilling fluid through the borehole and around the bit with sufficient velocity to remove the formation cuttings and the cuttings, fragments and dust worn loose from the bit, immersing a magnet within the drilling fluid stream to attract a portion of the ferrous bit cuttings, fragments and dust to the magnet thereby separating the ferrous material from the fluid stream, withdrawing the magnet from the fluid stream and removing the ferrous cutting, fragments and dust attracted thereto, separating the ferrous cuttings and fragments from the ferrous dust, examining the ferrous cuttings and fragments under an optical microscope and observing their shape and color and comparing the shape and color of the ferrous cuttings and fragments to the shape and color of ferrous cuttings and fragments indicative of known bit wear conditions.

16. The method of claim 15 and including the step of examining the ferrous dust under an optical microscope to determine the relative portion of dust particles which are silver in color, the portions which are bronze in color and the portions which are blue in color to thereby determine the relative temperatures at which they are formed.

17. The method of claim 15 and wherein the drilling fluid is drilling mud.

18. The method of claim 15 and wherein the drilling fluid is a gas.

19. The method of claim 15 and including the step of flowing the drilling fluid through a surge tank in which the magnet is immersed.

20. The method of claim 15 and wherein the ferrous dust is separated by selective screening.

21. The method of claim 15 and including the subsequent steps of:

again immersing the magnet at the same position within the fluid stream and allowing it to remain there for the same amount of time as it did previously, withdrawing the magnet from the fluid stream and removing all of the ferrous cuttings, dust and fragments attracted thereto, separating the ferrous cuttings and larger fragments from the ferrous dust, and observing the ferrous cuttings and fragments under an optical microscope and observing the shape and color of the cuttings and fragments and comparing this data to the shape and color of the cuttings and fragments recovered in the first instance.

22. The method of claim 21 and including the steps of:

weighing the ferrous material recovered by the first immersion, weighing the ferrous material recovered by the second immersion, and comparing the amount of ferrous material recovered by the two immersions to determine the change in rate of bit wear.

23. In a rotary drilling operation, a method for determining the wear of the bit comprising the steps of:

circulating a drilling fluid through the borehole and around the bit with sufficient velocity to remove the formation cuttings and the cuttings, fragments and dust worn loose from the bit, placing a magnet in sufficiently close proximity to the removed cuttings, fragments and dust to attract a portion of the ferrous cuttings, fragments and dust present therein to the magnet thereby separating the ferrous material from the removed formation cuttings, said magnet being tubular and being immersed in the drilling fluid stream, removing the attracted ferrous material from the magnet, and examining the ferrous material under an image magnification device suitable for the observation of the shape and color of the cuttings and fragments forming a portion of the ferrous material so as to permit an evaluation of the observed shape and color of the ferrous cuttings and fragments with respect to the shape and color of ferrous cuttings and fragments indicative of known conditions of rotary bit wear.

24. In a rotary drilling operation, a method for determining the wear of the bit comprising the steps of:

circulating a drilling fluid through the borehole and around the bit with sufficient velocity to remove the formation cuttings and the cuttings, fragments and dust worn loose from the bit, placing a magnet in sufficiently close proximity to the removed cuttings, fragments and dust to attract a portion of the ferrous cuttings, fragments and dust present therein to the magnet thereby separating the ferrous material from the removed formation cuttings, removing the attracted ferrous material from the magnet, washing the ferrous material in a solution of sodium acid pyrophosphate, and examining the ferrous material under an image magnification device suitable for the observation of the shape and color the cuttings and fragments forming a portion of the ferrous material so as to permit an evaluation of the observed shape and color of the ferrous cuttings and fragments with respect to the shape and color of ferrous cuttings and fragments indicative of known conditions of rotary bit wear.

25. In a rotary drilling operation, a method for determining the wear of the bit comprising the steps of:

circulating a drilling fluid through the borehole and around the bit with sufficient velocity to remove the formation cuttings and the cuttings, fragments and dust worn loose from the bit, placing a magnet in sufficiently close proximity to the removed cuttings, fragments and dust to attract a portion of the ferrous cuttings, fragments and dust present therein to the magnet thereby separating the ferrous material from the removed formation cuttings, and examining the ferrous material under an image magnification device suitable for the observation and shape and color of the cuttings and fragments forming a portion of the ferrous material so as to permit an evaluation of the observed shape and color of the ferrous cuttings and fragments with respect to the shape and color of ferrous cuttings and fragments indicative of known conditions of rotary bit wear.

* * * * *